United States Patent [19]

Mosley et al.

[11] Patent Number: 4,822,381

[45] Date of Patent: Apr. 18, 1989

[54] ELECTROPRECIPITATOR WITH SUPPRESSION OF RAPPING REENTRAINMENT

[75] Inventors: Ronald B. Mosley, Chapel Hill; Leslie E. Sparks, Durham; Norman Plaks, Raleigh, all of N.C.

[73] Assignee: Government of the United States as represented by Administrator Environmental Protection Agency, Washington, D.C.

[21] Appl. No.: 191,469

[22] Filed: May 9, 1988

[51] Int. Cl.[4] ..... B03C 3/00

[52] U.S. Cl. ..... 55/2; 55/136; 55/138; 55/151; 55/135

[58] Field of Search ..... 55/2, 135, 136–138, 55/151

[56] References Cited

U.S. PATENT DOCUMENTS

| | | | |
|---|---|---|---|
| 1,794,615 | 3/1931 | Hoss | 55/136 |
| 2,318,093 | 5/1943 | Penney | 55/138 |
| 3,816,980 | 6/1974 | Schwab | 55/123 |
| 3,994,704 | 11/1976 | Shibuya et al. | 55/138 |
| 4,018,577 | 4/1977 | Shibuya | 55/137 |
| 4,092,134 | 5/1978 | Kikuchi | 55/109 |
| 4,431,434 | 2/1984 | Rinard | 55/135 |
| 4,518,401 | 5/1985 | Pontius | 55/101 |

FOREIGN PATENT DOCUMENTS

| | | | |
|---|---|---|---|
| 2635789 | 2/1978 | Fed. Rep. of Germany | 55/138 |
| 2755059 | 6/1979 | Fed. Rep. of Germany . | |
| 1257312 | 3/1960 | France . | |
| 215135 | 11/1941 | Switzerland . | |
| 164014 | 7/1921 | United Kingdom . | |
| 643363 | 10/1947 | United Kingdom . | |

OTHER PUBLICATIONS

Nov. 1986–Science Advisory.

*Primary Examiner*—Bernard Nozick

[57] ABSTRACT

Apparatus and method are provided for reducing rapping reentrainment from a conventional electrostatic precipitator. Thus, the apparatus will include a conventional electrostatic precipitator having at least one main electrical section and, in sequence downstream of the main electrical section, a precharger and a reentrainment collector. The precharger has a tubular anode aligned with collection plates in the main electrical section and a corona discharge wire aligned with the corona discharge wires of the main electrical section. The reentrainment collector includes collection plates substantially shorter than the collection plates of the main electrical section with at least one corona discharge wire in each of the gaps between the collection plates. The secondary collection plates of the reentrainment collector are operated at a current density 75% or less of the current density at which the main collector plates are operated.

9 Claims, 2 Drawing Sheets

ELECTROPRECIPITATOR WITH SUPPRESSION OF RAPPING REENTRAINMENT

FIELD OF THE INVENTION

This invention relates to electrostatic precipitators (hereinafter "ESPs") and, more specifically, to apparatus and method of reducing particulate emissions from conventional ESPs due to rapping reentrainment.

PRIOR ART

Control of particulate emissions from industrial sources is presently accomplished largely by fabric filters and ESPs. The greatest volume of gas cleanup is accomplished by precipitators. Although a well designed precipitator is quite efficient (99.5 plus %), perhaps as much as 80% of the emissions are due to rapping reentrainment. Large modern precipitators have several electrical sections which help to minimize rapping reentrainment losses. A high degree of sectionalization tends to reduce rapping losses by allowing additional opportunities for reentrained particles to be recaptured before leaving the precipitator. It has been experimentally observed that the performance of well designed precipitators is usually limited by rapping losses. It has also been observed that about 10% of the mass collected in the last field of the precipitator is typically emitted as a result of rapping the last field. Consequently, if a collector is added which is 95% efficient in reducing emissions (without rapping), it could be expected to reduce the original emissions by about 85.5% when this collector is rapped regularly. This value corresponds to a substantial reduction in emissions.

In one or two installations in Japan, industrial precipitators have been fitted with an outlet electrical section which was operated wet in order to reduce reentrainment. Operating a precipitator wet solves both reentrainment and high resistivity problems. However, when only one section is operated wet a number of operational problems arise. For instance, unless the flue gas temperature is below the saturation value, it is very difficult to uniformly wet the plates. Dry spots develop and back corona becomes a problem with high resistivity particle matter. A significant economic drawback to a wet section is the extra cost of operating a separate wet ash disposal system. Precipitators with moving plates which are cleaned by brushes mounted on the back side out of the gas stream have been built in Japan. Although these devices avoid the problems of rapping reentrainment, they are very difficult to keep operating in such a dirty environment. Installation of these devices requires a great deal of space. They do not mesh very well with conventionally designed precipitators. Neither of these technologies are readily retrofittable to conventional precipitators; especially those with limited space for physical expansion.

SUMMARY OF THE INVENTION

Accordingly, it is an object of the present invention to provide highly efficient means and method for reducing reentrainment emissions. It is another object of the present invention to provide such an apparatus which is retrofittable to conventional ESPs, i.e. apparatus requiring considerably less space than a single electrical section of a conventional ESP.

The present invention combines a reentrainment suppressor with a conventional ESP and divides the charging and collecting functions of the reentrainment suppressor into separate precharging and collection sections, thus allowing each component of the system to be operated in a manner allowing optimum performance of the intended component function.

By separating the dust charging and dust collection functions of the reentrainment suppressor into separate sections, the collector plates within the reentrainment suppressor section may be operated at less than 75% the current density of the collectors within the main section. This enables the dust layer accumulated on the collector plates in the reentrainment suppressor section to be more easily removed which, in turn, significantly reduces the rapping force required and duration of rapping. Thus, as a percentage of collected dust, there is significantly less rapping reentrainment from the reentrainment suppressor than from the main electrical sections.

Accordingly, the present invention provides an electrostatic precipitator including, in series, a main electrical section and, as the last collector stage, a reentrainment suppressor. The main electrical section includes a plurality of positively charged main collection plates evenly spaced to define a plurality of gas flow lanes therebetween, and a linear array of main corona discharge wires operated at negative polarity within each of the main gas flow lanes. The reentrainment suppressor section or module, in turn, is divided into two sections, a precharger and a collector. The precharger is located downstream of the main electrical section and has a single tubular anode aligned with each of the main collection plates and at least one precharger corona discharge wire aligned with each of the linear arrays of main corona discharge wires. The corona discharge wire is operated at negative polarity and the tubular anode at positive polarity. The reentrainment collector, downstream of the precharger, is provided wth plurality of secondary collector plates, each of the secondary collector plates being aligned with one of said main collection plates, thereby extending said gas flow lanes, and being substantially shorter than the main collection plates in the direction of the gas flow. The reentrainment collector further includes at least one collector corona discharge wire in each of the gas flow lanes and between the secondary collector plates.

The present invention further provides a method of retrofitting a conventional ESP, having plural main electrical sections as described above, with the objective of reducing rapping reentrainment. Toward this end, the reentrainment suppressor as described herein (precharger and collector) is attached in a conventional manner to the last section of the conventional ESP.

DESCRIPTION OF THE PREFERRED EMBODIMENT

Figure 1:
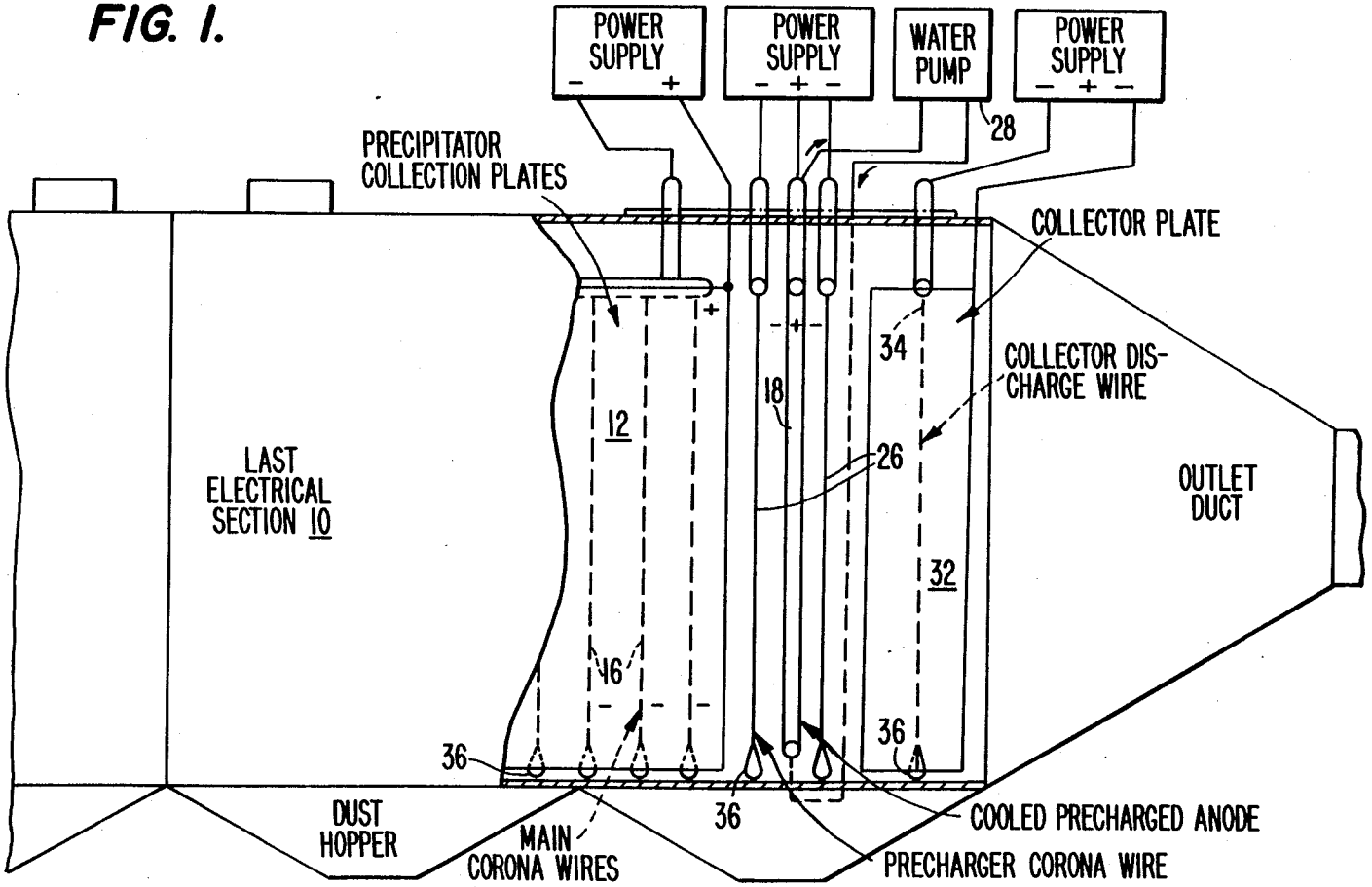
FIG. 1 is an elevational view, partially in cross-section, of an ESP in accordance with the present invention.
Figure 2:
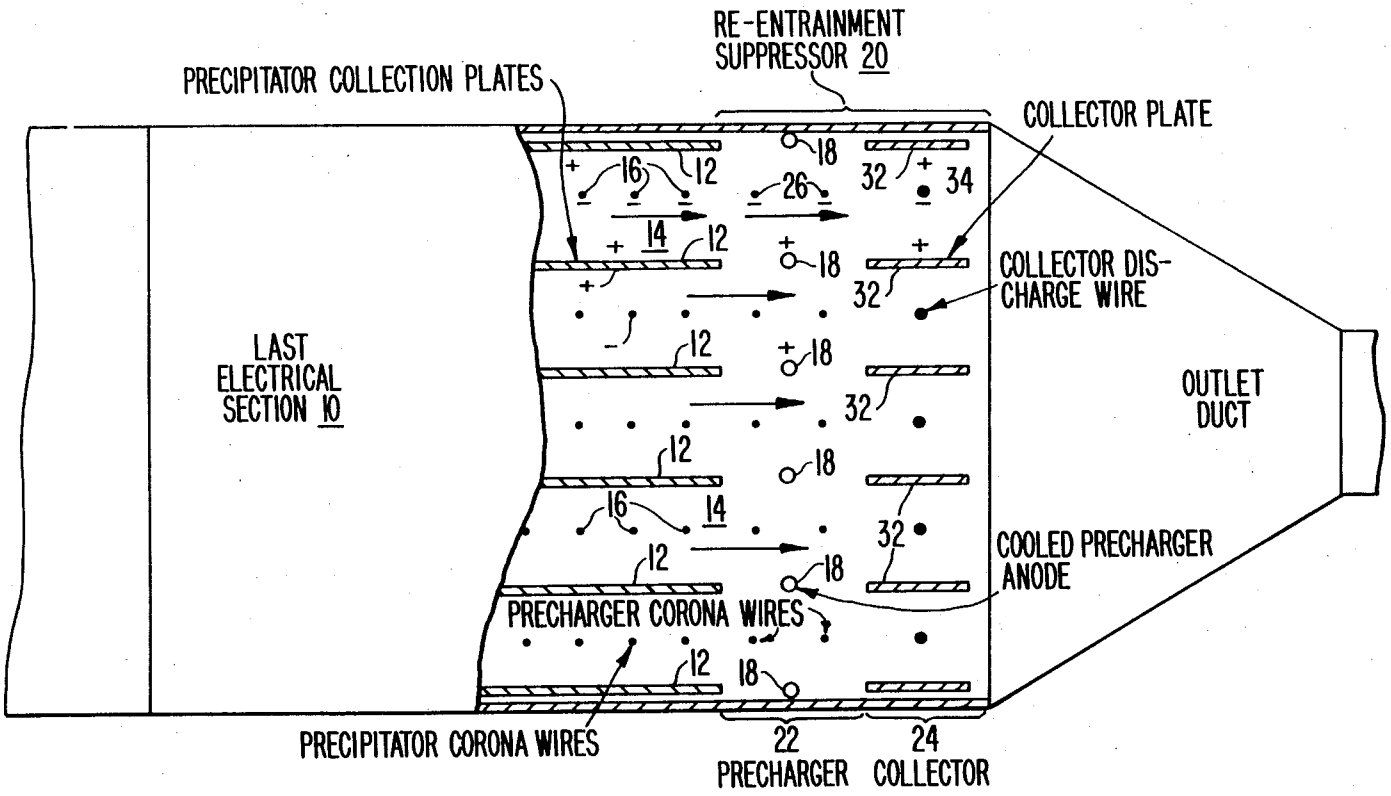
FIG. 2 is a plan view, partially in cross section, of the ESP of FIG. 1.

A preferred embodiment of the present invention is shown in FIGS. 1 and 2 of the drawings. The last electrical section 10 of a multi-section, conventional electroprecipitator 10 is provided with evenly spaced collector plates 12 which define therebetween a plurality of gas flow paths 14. Arranged in a linear array between each pair of main collector plates 12 is a series of corona discharge wires 16. In the embodiment shown, nine corona discharge wires would be arranged in a linear array within each gas flow path between the ends of collector plates 12. A conventional electroprecipitator would have 6–15 corona discharge wires in each linear array or, more commonly, about 8–10 such wires. A typical diameter for such corona discharge wires would be 3.18 mm. Typically, such an electrical section would be operated at a field strength of 2.2–3.0 kV/cm and with a current density of 2.0–10.0 nA/cm$^2$ in the case of a relatively high resistivity particulate matter. In the case of a lower resistivity particulate matter the electrical section 10 would typically be operated with a field strength of 3.5–4.0 kV/cm and a current density of 30–80 nA/cm$^2$.

Immediately downstream of the last electrical section 10 is the reentrainment suppressor 20. Reentrainment suppressor 20 includes a plurality of hollow anodes 18 through which a suitable cooling fluid is circulated by appropriate means such as water pump 28. The reentrainment suppressor 20 is subdivided into two functionally different sections, i.e. a precharger 22 and a collector 24. The precharger 22 contains the aforementioned cooled anodes 18 and a pair of corona discharge wires 26, immediately upstream and immediately downstream of the cooled anodes 18. By cooling anodes 18 the resistivity of any dust collecting thereon can be lowered thereby reducing back-corona within the collected dust to a minimum. Corona discharge wires 26 are aligned with corona discharge wires 16 of the main collector (last electrical) section. Likewise, the cooled anodes 18 are aligned with collector plates 12. In point of fact, the collection of dust on anodes 18 will be very small as compared to the collection of dust on the various collector plates for several reasons. Firstly, the geometry of the anodes, i.e. round, is not conducive to the collection of dust. Secondly, the length of the precharger section and the width of the anodes 18 is so small that the residence time of the particles in passing anodes 18 is so short as to allow little opportunity for adherence and collection. Immediately downstream of precharger 22 is the reentrainment collector 24 which includes a plurality of evenly spaced collector plates 32, aligned with collector plates 12 thereby extending the defined gas flow paths 14. The reentrainment collector 24 further includes a single corona discharge wire 34 located in each of the gas flow paths 14. In the embodiment shown, the length of collector plates 32 would be approximately one-ninth of the length of collector plates 12. In the preferred embodiment the corona discharge wires 34 of the reentrainment collector 24 would be braided wires at least twice and, more preferably, about three times the diameter of corona discharge wires 16 and 26. Although the collector section of the reentrainment suppressor is shown as having only a single corona discharge wire 34 per gas flow path, space permitting, two or more such corona discharge wires could be employed. In operation the precharger of the reentrainment suppressor would be operated with a field strength of 5.0–6.0 kV/cm and a current density of 70–130 nA/cm$^2$. For a high resistivity dust the collector of the reentrainment suppressor would be operated at a field strength of 2.5–3.6 kV/cm and a current density of 1.0–7.0 nA/cm$^2$. For a low resistivity dust the collector section of the reentrainment suppressor would be operated at a field strength of 3.5–4.0 kV/cm and a current density of 12.0–32.0 nA/cm$^2$.

Corona discharge wires 34 are preferably braided in view of their relatively large diameter. As shown in FIG. 1 each of corona discharge wires 16, 26 and 34 is pulled straight by means of a weight 36. This is necessary for proper alignment of the corona discharge wire and efficient operation of the ESP. As the diameter of the wire is increased, a larger weight would be required to straighten the wire unless the wire is made more flexible. Accordingly, in order to avoid any excessive increase in weight a braided wire is used for the larger diameter corona discharge wires 34.

In actual operation, the operating field strength and current density will vary with the nature of the dust, specifically the resistivity of the dust. While the aforementioned ranges for field strength for a low resistivity dust are the same for both section 10 and section 20, in actual practice, for a given dust, the field strength within the reentrainment collector will be approximately 20% higher than the field strength within the main electrical sections of the ESP. Because efficiency varies with the square of the field strength, a small increase in field strength translates to a very significant increase in dust removal efficiency. The current density for corona discharge wires 34 is less than 75%, and preferably less than 50% that of wires 16 and 26. The lower current density within the reentrainment collector, as compared to the main electrical sections, is also highly significant. Due to the lower current density, the dust is easier to remove from the reentrainment collector by rapping as compared with dust removal within the main electrical sections. Also due to the lower current density, back corona is suppressed thus allowing higher collection fields. In other words, rapping of the collector plates within the reentrainment suppressor would not require as much force or duration as compared with rapping of collection plates within the main electrical sections. Due to the lower rapping force, the shorter rapping period and the nature of the dust deposit itself, i.e. the manner in which it breaks off from the collector plates, a lower percentage of the deposited dust is reentrained as compared with deposited dust removed from the collector plates within the main electrical sections. This advantage is especially significant in that the reentrainment suppressor is the last stage through which the gas stream passes. In actual practice, it is anticipated that the anodes within the precharger would be rapped approximately every four to five hours receiving only a few raps (5 or less) at a time. It is estimated that the reentrainment collector would require rapping only approximately every ten to fifteen hours. In contradistinction, assuming that the main ESP has three electrical sections in series, the first section would be rapped every ten to fifteen minutes, the second section every half hour to one hour and the last section every one hour to two hours. Thus, the frequency of rapping for the reentrainment collector would be one-fourth or less the frequency of rapping for the collector plates within the main electrical sections.

The invention may be embodied in other specific forms without departing from the spirit or essential characteristics thereof. Accordingly, the foregoing preferred embodiments should be considered merely as illustrative, and not restrictive, of the scope of the invention. The scope of the invention is indicated by the appended claims rather than by the foregoing description and all changes which come within the meaning and range of equivalency of the claims are therefore intended to be embraced therein.

We claim:

1. A method of reducing rapping reentrainment from an electrostatic precipitator comprising, in series, at least one main electrical section comprising a plurality of positively charged main collection plates, said main collection plates being evenly spaced to define a plurality of gas flow lanes therebetween, and a linear array of main corona discharge wires within each of said main gas flow lanes; said method comprising:

attaching to said electrostatic precipitator, as the last stage thereof, a reeintrainment suppressor comprising: a precharger, downstream of said main electrical section, having a single tubular anode aligned with each of said main collection plates and at least one precharger corona discharge wire aligned with each of said linear arrays of main corona discharge wires; and a reentrainment collector downstream of said precharger and having a plurality of secondary collector plates, each of said secondary collector plates being aligned with one of said main collection plates, thereby extending said gas flow lanes, and being substantially shorter than said main collection plates in the direction of the gas flow and at least one collector corona discharge wire in each of said gas flow lanes between said secondary collector plates; and passing a gas stream containing particulate solids successively through said one main electrical section, said precharger and said reentrainment collector.

2. The method of claim 1 wherein the secondary collector plates are operated at a current density less than 75% of the current density of the main collector plates.

3. A method of removing particulate material from a gas stream comprising:

providing an electrostatic precipitator comprising in series:

at least one main electrical section comprising a plurality of positively charged main collection plates, said main collection plates being evenly spaced to define a plurality of gas flow lanes therebetween, and a linear array of main corona discharge wires within each of said main gas flow lanes; and a reentrainment suppressor comprising:

a precharger, downstram of said main electrical section, having a single tubular anode aligned with each of said main collection plates and at least one precharger corona discharge wire aligned with each of said linear arrays of main corona discharge wires; and a reeintrainment collector downstream of said precharger and having a plurality of secondary collector plates, each of said secondary collector plates being aligned with one of said main collection plates, thereby extending said gas flow lanes, and being substantially shorter than said main collection plates in the direction of the gas flow and at least one collector corona discharge wire in each of said gas flow lanes between said secondary collector plates, wherein the diameter of each of said collector corona discharge wires is at least twice that of said main corona discharge wires and said precharger corona discharge wire; and passing said gas stream through said electrostatic precipitator and operating said secondary collector plates at a current density less than 75% of the current density of the main collector plates.

4. An electrostatc precipitator comprising, in series;

at least one main electrical section comprising a plurality of positively charged main collection plates, said main collection plates being evenly spaced to define a plurality of gas flow lanes therebetween, and a linear array of main corona discharge wires within each of said main gas flow lanes; and a reentrainment suppressor comprising:

a precharger, downstream of said main electrical section, having a single tubular anode aligned with each of said main collection plates and at least one precharger corona discharge wire aligned with each of said linear arrays of main corona discharge wires; and a reentrainment collector downstream of said precharger and having a plurality of secondary collector plates, each of said secondary collector plates being aligned with one of said main collection plates, thereby extending said gas flow lanes, and being substantially shorter than said main collection plates in the direction of the gas flow and at least one collector corona discharge wire in each of said gas flow lanes between said secondary collector plates.

5. The electrostatic precipitator of claim 4 wherein only one collector corona discharge wire is located in each gas flow lane within said reentrainment suppressor.

6. The electrostatic precipitator of claim 1 wherein said precharger has only two precharger corona discharge wires in each gas flow lane, one of said two precharger corona discharge wires being located upstream of and the other downstream of said tubular anodes.

7. The electrostatic precipitator of claim 1 additionally comprising means for circulating a heat exchange fluid through said tubular anodes.

8. The electrostatc precipitator of claim 1 wherein the diameter of each of said collector corona discharge wires is at least twice that of said main corona discharge wires and said precharger corona discharge wires.

9. The electrostatic precipitator of claim 4 wherein, in the direction of the gas flow, said secondary collection plates are one-sixth to one-fifteenth the length of said main collection plates.

* * * * *